United States Patent [19]

Makino et al.

[11] Patent Number: 4,620,951

[45] Date of Patent: Nov. 4, 1986

[54] SLIDABLE THROTTLE VALVE ASSEMBLY FOR A CARBURETOR AND ASSOCIATED METHOD OF OPERATION

[75] Inventors: Tomoaki Makino, Asaka; Masahiro Arakawa, Niiza; Tomiyoshi Mitsui, Saitama, all of Japan

[73] Assignee: Honda Giken Kogyo Kabushiki Kaisha, Tokyo, Japan

[21] Appl. No.: 737,147

[22] Filed: May 23, 1985

[30] Foreign Application Priority Data

Aug. 28, 1984 [JP] Japan ..... 59-178872

[51] Int. Cl.[4] ..... F02M 9/06

[52] U.S. Cl. ..... 261/44.3; 251/326; 251/333

[58] Field of Search ..... 261/44 B; 251/326, 333

[56] References Cited

U.S. PATENT DOCUMENTS

| | | | |
|---|---|---|---|
| 881,060 | 3/1908 | Cook | 251/333 |
| 1,720,938 | 7/1929 | Veenschoten | 251/326 |
| 1,863,712 | 6/1932 | Byfield | 251/333 |
| 2,047,661 | 7/1936 | Arff | 261/44 B |
| 2,962,039 | 11/1960 | Shand et al. | 251/333 |
| 3,295,546 | 1/1967 | Carlton | 251/326 |
| 4,008,298 | 2/1977 | Quantz | 261/44 B |
| 4,040,600 | 8/1977 | Coppola et al. | 251/333 |
| 4,465,644 | 8/1984 | Stojek | 261/44 B |

FOREIGN PATENT DOCUMENTS

| | | | |
|---|---|---|---|
| 428443 | 4/1911 | France | 261/44 B |
| 651542 | 2/1929 | France | 261/44 B |
| 59-101570 | 6/1984 | Japan | 261/44 B |
| 192934 | 2/1923 | United Kingdom | 261/44 B |

*Primary Examiner*—Tim Miles

*Attorney, Agent, or Firm*—Roberts, Spiecens & Cohen

[57] ABSTRACT

A slidable throttle valve assembly for a carburetor comprising a carburetor body with an intake passage therein, a slidable throttle valve movable across the intake passage, and a throttle valve guide tube connected to the carburetor body and guidably supporting the slidable throttle valve. The carburetor body has guide grooves for guiding the slidable throttle valve which are respectively provided in the body at opposite sides of the intake passage so as to be continuous with the throttle valve guide tube. The throttle valve and guide grooves are of part-circular, cross-sectional shape so that the throttle valve and guide grooves come into contact with each other respectively along lines extending in the sliding direction of the slidable throttle valve downstream of the intake passage.

11 Claims, 5 Drawing Figures

SLIDABLE THROTTLE VALVE ASSEMBLY FOR A CARBURETOR AND ASSOCIATED METHOD OF OPERATION

FIELD OF THE INVENTION

The present invention relates to a slidable throttle valve assembly for a carburetor.

More particularly, the invention relates to a carburetor having a slidable throttle valve which comprises a carburetor body having an air intake passage therein; a throttle valve guide tube connected to the carburetor body for guiding a slidable throttle valve which slides across the intake passage to control air flow; and guide grooves for guiding the throttle valve, the guide grooves being respectively provided on both sides of the intake passage so as to be continuous with the throttle valve guide tube.

DESCRIPTION OF THE PRIOR ART

One embodiment of a conventional carburetor with a slidable throttle valve is shown in FIG. 4, wherein a slidable throttle valve 65 has a rectangular cross-sectional shape and is slidable in rectangular guide grooves 66,67 provided at both sides of intake passage 2.

Another embodiment of a carburetor with a conventional slidable throttle valve is shown in FIG. 5. Therein the throttle valve 68 has a circular cross-section and the intake passage 2 is provided at both sides thereof with circular guide grooves 69,70 corresponding to both side portions of the slidable throttle valve 68.

The prior art constructions shown in FIGS. 4 and 5 are subject to the following problems. During the operation of the engine, an intake vacuum is applied to slidable throttle valves 65 and 68 at the downstream side of the intake passage 2 so that the slidable throttle valves 65 and 68 are moved by means of the vacuum downstream in the direction of flow of the intake air as shown by numeral 8. Accordingly, in the prior art arrangement shown in FIG. 4, the slidable throttle valve 65 is brought into close contact with respective side surfaces 66', 67' of the guide grooves 66,67, which side surfaces face upstream, to function as a seal. However, both of the side surfaces 66', 67' are flat and, therefore, both of the side portions of the slidable throttle valve 65 respectively come into planar contact with the side surfaces 66', 67' with a relatively low contact pressure, and therefore the sealing properties are relatively poor. On the other hand, in the prior art arrangement shown in FIG. 5, a rear portion of the throttle valve 68 comes into line contact with a portion of the inner surface of a throttle valve guide tube 71 at the downstream end thereof, which undesirably forms minute gaps between both side portions of the slidable throttle valve 68 and the corresponding guide grooves 69,70 whereby the throttle valve 69 cannot satisfactorily function as a seal.

SUMMARY OF THE INVENTION

A primary object of the present invention is to provide a slidable throttle valve assembly for a carburetor which is capable of satisfactorily sealing the areas between the slidable throttle valve and the guide grooves of the intake passage.

According to the present invention, the arrangement is such that the slidable throttle valve and both guide grooves come into line contact with each other in the sliding direction of the slidable throttle valve on the downstream side of the intake passage.

The vacuum produced in the intake passage causes the slidable throttle valve to be displaced downstream such that the slidable throttle valve comes into line contact with both guide grooves, whereby satisfactory sealing is effected by a contact pressure which is adequate for this purpose.

DETAILED DESCRIPTION OF PREFERRED EMBODIMENTS

Figure 1:
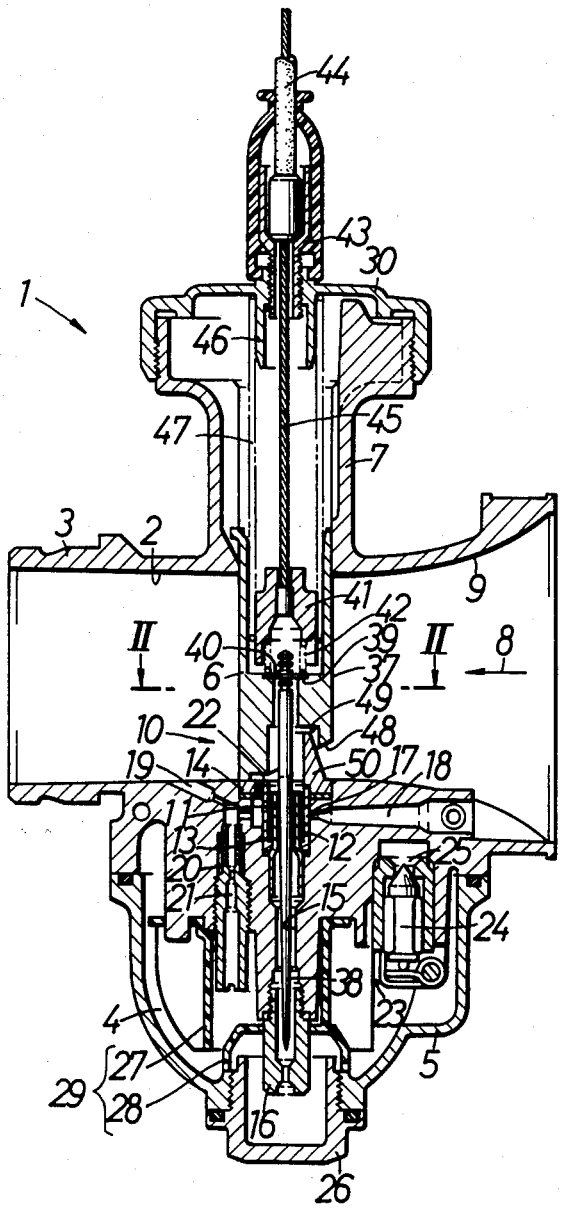
FIG. 1 is a vertical sectional view of one embodiment of a slidable throttle valve assembly of a carburetor according to the invention.

Referring first to FIG. 1 showing one embodiment of the present invention, therein is seen a slidable throttle valve assembly 1 for a carburetor which includes a carburetor body 3 having an air intake passage 2 therein and a float chamber member 5 connected to a lower portion of the carburetor body 3 to define a float chamber 4. A slidable throttle valve 6 is slidable across the intake passage 2 to control air flow and fuel mixture, and a throttle valve guide tube 7 is integrally formed with an upper portion of the carburetor body 3 to guide the slidable throttle valve 6.

The intake passage 2 has, at the upstream end thereof relative to the direction of flow of intake air 8, a curved air horn 9 which gradually diverges towards the upstream side. The intake passage 2 further has a venturi portion 10 of circular cross-section at a longitudinally intermediate portion thereof.

A main fuel nozzle 11 is disposed at a lower portion of the carburetor body 3 to open into the venturi portion 10. A cylindrical collar 13 surrounds the main fuel nozzle 11, and defines an annular chamber 12 between the collar 13 and the nozzle 11. A jet block 14 is fixedly fitted into the lower surface of the intake passage 2 above the collar 13. The collar 13 is clamped between the jet block 14 and the carburetor body 3, such that the main fuel nozzle 11 fitted in the carburetor body 3 is held by the collar 13. A passage 15 communicating with the main fuel nozzle 1 is bored in the lower portion of the carburetor body 3. A main fuel jet 16 opening under the surface of the fuel contained in the float chamber 4 is screwed into the lower portion of the carburetor body 3 so as to communicate with the passage 15. Additionally, a through-hole 17 is bored in a side wall of the collar 13 so as to communicate with the annular chamber 12. The through-hole 17 is in communication with the upstream end of the intake passage 2 through an air passage 18 in the carburetor body 3. Accordingly, air is introduced into the annular chamber 12 from the upstream end of the intake passage 2.

Additionally, a low-speed fuel nozzle 19 is formed in the lower portion of the carburetor body 3 so as to open at the inner surface of the intake passage 2 on the downstream side of the venturi portion 10. The low-speed fuel nozzle 19 is in communication with the float chamber 4 under the surface of the fuel contained therein through a bleeder pipe 20 and a low-speed fuel jet 21. Furthermore, the joint between the low-speed fuel nozzle 19 and the bleeder pipe 20 is in communication with the venturi portion 10 through a small-diameter passage 22 in the jet block 14.

In the float chamber 4 is a float 23 which opens and closes a float valve 24 in response to the movement of the float 23. The float valve 24 opens and closes a fuel inlet 25. A stopper 26 is screwed into the bottom portion of the float chamber member 5. Moreover, between the float chamber member 5 and the lower portion of the carburetor body 3 is clamped a synthetic-resin buffer member 29 composed of a buffer plate 27 and a jet cover 28 which are integral with each other, the buffer plate 27 serving to suppress oscillation of the surface of the fuel contained in the float chamber 4, and the jet cover 28 serving to retain the fuel in the vicinity of the opening of the main fuel jet 16.

The throttle valve guide tube 7 is integrally formed with the upper portion of the carburetor body 3 so as to open into the venturi portion 10. The throttle valve guide tube 7 is closed at its upper end with a cover 30.

Figure 2:
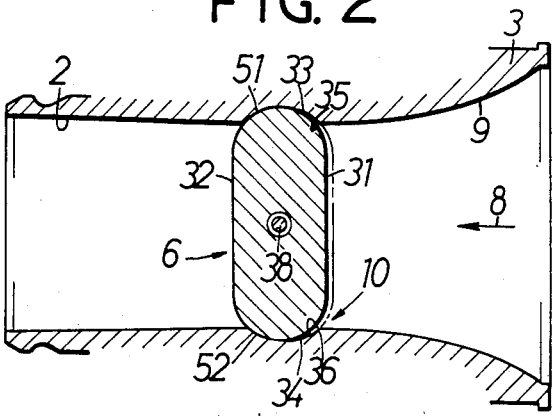
FIG. 2 is a sectional view taken along line II—II in FIG. 1.

Referring now to FIG. 2, the slide throttle valve 6 has a cross-section of flattened oval shape which is elongated in a direction perpendicular to the direction of flow of intake air 8. In particular, the cross-section of the valve 6 is composed of a pair of flat plate-like side surfaces 31,32 extending perpendicularly to the direction of flow of intake air and a pair of semi-circular side surfaces 33,34 connecting the flat plate-like side surfaces 31,32. The inner surface of the throttle valve guide tube 7 also has a cross-section of flattened oval shape so that the throttle valve 6 slidably fits therein.

At side portions of the venturi portion 10 in the intake passage 2, a pair of guide grooves 35,36 of circular cross-section are formed so as to be continuous with the throttle valve guide tube 7 and such that the respective semi-circular side surfaces 33,34 of the slide throttle valve 6 slidably fit therein.

The respective shapes of the slide throttle valve 6 and the guide grooves 35,36 allow both of the side portions of the slidable throttle valve 6 to come into line contact with the corresponding guide grooves 35,36 in the sliding direction of the slidable throttle valve 6 downstream of the intake passage in response to intake vacuum which acts on the valve 6 during the operation of the engine.

Referring back to FIG. 1, the slidable throttle valve 6 has a solid support portion 37 in its lower section and is formed in the shape of a tube of flattened oval cross-section. The main fuel nozzle 11 and jet needle 38 which is received in the passage 15 are disposed in the support portion 37 so as to extend therethrough vertically. The support portion 37 is provided on the upper surface thereof with an engagement recess 39. The jet needle 38 is provided, at the upper portion thereof, with a retainer collar 40 which is engageable with the engagement recess 39. The retainer collar 40 is adapted to be selectively fitted at one of a plurality of positions on the jet needle 38 spaced in the longitudinal direction thereof. A cable holder 41 is detachably engaged in the slide throttle valve 6, and a spring 42 is interposed between the cable holder 41 and the retainer collar 40. Accordingly, the retainer collar 40 is pressed toward the engagement recess 39, whereby the jet needle 38 is retained at the support portion 37.

A guide pipe 43 is screwed into the cover 30 which, in turn, is screwed into the upper end of the throttle valve guide tube 7. An outer wire 44 is received in the guide pipe 43. An inner wire 45 movable in the outer wire 44 extends in the throttle valve guide tube 7 and is connected to the cable holder 41. A tubular projection 46 is provided at the central portion of the inner surface of the cover 30. Between the cover 30 and the cable holder 41 is interposed a coil spring 47 to surround the tubular projection 46. Accordingly, the slide throttle valve 6 is urged by the spring force of the coil spring 47 in the direction in which the valve 6 closes the venturi portion 10. The slide throttle valve 6 can be opened by pulling the inner wire against the spring force of the coil spring 47.

A cutaway 48 is provided at the bottom portion of the slide throttle valve 6 to face upstream in intake passage 2. The bottom portion of the valve 6 is provided with a recess 49 opening downwardly. Furthermore, the jet block 14 is integrally provided with a screen 50 on the upstream side of the jet needle 38. The screen 50 is able to enter into the recess 49 when the slide throttle valve 6 is closed.

The operation of the apparatus is as follows.

In response to the operation of the engine, an intake vacuum is produced in the intake passage 2, and a suction force corresponding to the intake vacuum acts upon the slidable throttle valve 6 urging the throttle valve downstream. The suction force causes both the side portions of the slidable throttle valve 6 to be pressed against the respective downstream side surfaces of the guide grooves 35,36. In this case, however, both the side portions of the slide throttle valve 6 are respectively provided with the semi-circular side surfaces 33,34, and each of the guide grooves 35,36 is formed of a circular shape in correspondence with the associated semi-circular side surface 33 or 34. In consequence, a slight displacement of the slidable throttle valve 6 downstream in the direction of intake air flow 8 causes the semi-circular side surfaces 33,34 and the guide grooves 35,36 to respectively come in line contact with each other at contact points 51,52 on imaginary straight lines parallel to the sliding direction of the throttle valve 6 (see FIG. 2). Accordingly, the slidable throttle valve 6 and both the guide grooves 35,36 come into contact with each other at sufficiently high contact pressure, so that the slidable throttle valve 6 can satisfactorily seal the area between the upstream and downstream sides thereof when the valve 6 is totally closed.

Furthermore, the formation of the guide grooves 35,36 in a circular shape makes it possible to reduce the required depth of each of the guide grooves 35,36, whereby turbulence of the air intake stream is minimized.

At rest, there is a slight clearance between the surfaces 33,34 of the throttle valve and the opposite surfaces 35,36 of the guide grooves which is achieved by a slight difference in radii of curvature of respective surfaces 33,34 and 35,36. This clearance is taken-up to produce the line contact between the surfaces when the throttle valve is displaced downstream by the vacuum in the intake passage.

Figure 3:
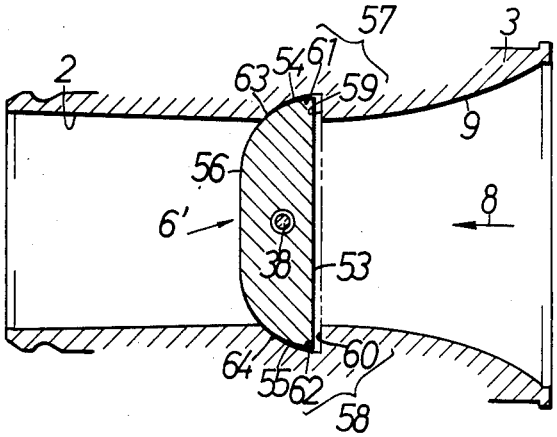
FIG. 3 is a horizontal sectional view, corresponding to FIG. 2, of another embodiment of the present invention.
Figure 4:
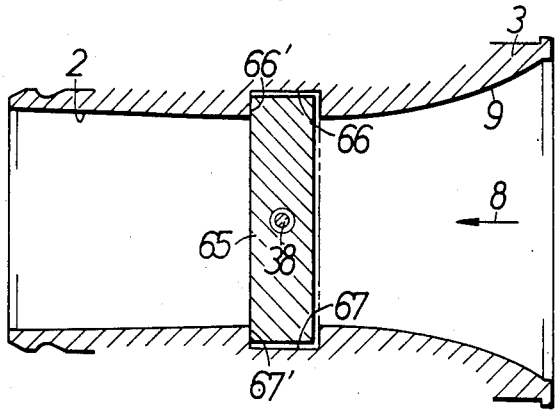
FIG. 4 PRIOR ART
FIGS. 4 and 5 are horizontal sectional views similar to FIG. 2 but showing embodiments according to the prior art.
Figure 5:
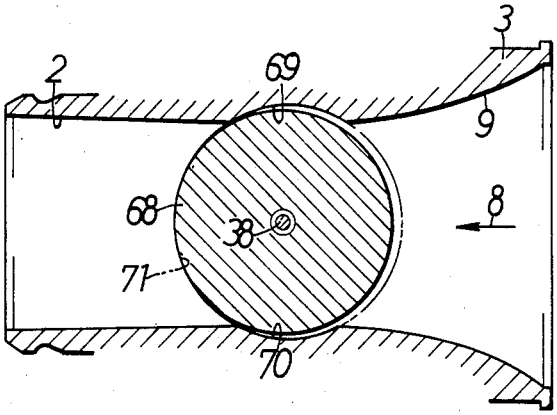
FIG. 5 PRIOR ART

Referring next to FIG. 3, which shows another embodiment of the present invention, slidable throttle valve 6' as a cross-sectional shape corresponding to one-half of a flattened oval shape. More specifically, the cross-sectional shape of the slidable throttle valve 6' comprises a flat plate-like side surface 53 on the upstream side of the valve 6', circular side surfaces 54,55 respectively extending downstream from both ends of the side surface 53 so as to form quarter circles and a flat plate-like side surface 56 connecting the circular side surfaces 54,55. Guide grooves 57,58 are respectively provided at both side portions of the intake passage 2 and include flat portions 59,60 corresponding to the flat plate-like side surface 53 and circular portions 61,62 corresponding to the circular side surfaces 54,55.

According to this embodiment, the slide throttle valve 6' is displaced by intake vacuum downstream in the direction of flow of intake air 8, whereby the circular side surfaces 54,55 respectively come into line contact with the respective circular portions 61,62 of the guide grooves 57,58 at points of contact 63,64. Accordingly, the slidable throttle valve 6' and the guide grooves 57,58 come into contact with each other under sufficiently high contact pressure, so that the sealing properties of the slidable throttle valve 6' in its totally closed state are assured.

As has been described above, according to the present invention, the arrangement is such that the slidable throttle valve and both the guide grooves come into line contact with each other on the downstream side of the intake passage and thereby the slidable throttle valve and both guide grooves come into contact with each other under sufficiently high contact pressure to assure the sealing properties of the valve.

Although the invention has been described in relation to specific preferred embodiments thereof, it will become apparent to those skilled in the art that numerous modifications and variations can be made without departing from the scope and spirit of the invention as defined in the attached claims.

What is claimed is:

1. In a slidable throttle valve assembly for a carburetor having a carburetor body with an intake passage therein; a slidable throttle valve guide tube connected to said carburetor body and guidably supporting said slidable throttle valve, said carburetor body having guide grooves for guiding said slidable throttle valve, said guide grooves being respectively provided in said body at opposite sides of said intake passage so as to be continuous with said throttle valve guide tube, the improvement wherein said throttle valve and said guide grooves are so shaped that said throttle valve and said guide grooves come into contact with each other respectively along lines extending in the sliding direction of said slidable throttle valve at downstream portions of said throttle valve, said throttle valve and guide grooves having a slight difference in curvature of respective surfaces adjacent their lines of contact during operation.

2. The improvement as claimed in claim 1 wherein said throttle valve and guide grooves are of rounded shape.

3. The improvement as claimed in claim 2 wherein said throttle valve and guide grooves are of part-circular shape.

4. The improvement as claimed in claim 1 wherein said guide grooves are each formed with part-circular surfaces and said throttle valve includes end portions with complementary part-circular surfaces, said end portions of said throttle valve being slidably fitted in said guide grooves with said part-circular surfaces of said guide grooves and said end portions facing one another.

5. The improvement as claimed in claim 4 wherein said throttle valve has planar surfaces respectively facing upstream and downstream in said intake passage connected to said part-circular surfaces of said end portions.

6. The improvement as claimed in claim 5 wherein said part-circular surfaces of said throttle valve are semi-circular.

7. The improvement as claimed in claim 5 wherein said part-circular surfaces of said throttle valve are quarter circles.

8. A method of guiding the sliding movement of a slidable throttle valve in a carburetor body having an air intake passage, said method comprising supporting a throttle valve for movement across an air intake passage in a carburetor body by slidably engaging end portions of the throttle valve in coextensive grooves respectively provided in a guide tube fixed to the carburetor body and in the wall of the intake passage for each end portion of the throttle valve and forming said grooves in the wall and said end portions of the slidable throttle valve so that upon operation, when air flows in said intake passage, suction force is applied to said throttle valve urging said valve downstream in said air intake passage and causing said end portions of the valve respectively to contact said grooves along lines extending in the sliding direction of said slidable throttle valve at downstream portions of the throttle valve to achieve sealing at said end portions, said throttle valve and guide grooves having a slight difference in curvature of respective surfaces adjacent their lines of contact during operation.

9. A method as claimed in claim 8 wherein at each end portion at least one of said groove and end portions is formed with a rounded surface.

10. A method as claimed in claim 8 wherein the line of contact between each end portion of the throttle valve and its associated groove in the wall takes place on a downstream surface of said end portion and a downstream surface of said groove.

11. A method as claimed in claim 10 wherein said line of contact extends substantially parallel to the direction of slidable movement of the throttle valve in said guide tube and said grooves.

* * * * *